US008894313B2

(12) United States Patent
Toh et al.

(10) Patent No.: US 8,894,313 B2
(45) Date of Patent: Nov. 25, 2014

(54) CONSUMER CARE PACKAGING

(75) Inventors: Kiat-Cheong Toh, Forest Hills, NY (US); Jonas Damon, New York, NY (US); Daniel Antonio Pacis-Sanchez, Brooklyn, NY (US); Allison Stacey Conner, Brooklyn, NY (US)

(73) Assignee: Colgate-Palmolive Company, New York, NY (US)

( * ) Notice: Subject to any disclaimer, the term of this patent is extended or adjusted under 35 U.S.C. 154(b) by 552 days.

(21) Appl. No.: 13/130,410

(22) PCT Filed: Dec. 21, 2010

(86) PCT No.: PCT/US2010/061612

§ 371 (c)(1),
(2), (4) Date: May 20, 2011

(87) PCT Pub. No.: WO2012/087300

PCT Pub. Date: Jun. 28, 2012

(65) Prior Publication Data

US 2012/0219349 A1 Aug. 30, 2012

(51) Int. Cl.

| | |
|---|---|
| ***B43K 7/00*** | (2006.01) |
| ***A45D 40/00*** | (2006.01) |
| ***A45D 34/04*** | (2006.01) |

(52) U.S. Cl.

CPC ..... *A45D 34/041* (2013.01); *A45D 40/0087* (2013.01)

USPC ..... 401/209; 401/213

(58) Field of Classification Search

CPC ..... A45D 40/0087; A45D 34/041

USPC ..... 401/209, 213, 215, 216, 218, 219; D9/726–729

See application file for complete search history.

(56) References Cited

U.S. PATENT DOCUMENTS

| | | | |
|---|---|---|---|
| D112,696 | S | 12/1938 | Havekost |
| D169,642 | S | 5/1953 | St. Clair |

(Continued)

FOREIGN PATENT DOCUMENTS

| | | |
|---|---|---|
| CD | 000573431-0005 | 10/2006 |
| CD | 000573431-0006 | 10/2006 |

(Continued)

OTHER PUBLICATIONS

International Search Report and the Written Opinion of the International Searching Authority issued in International Application PCT/US2010/061612 mailed Mar. 7, 2013.

(Continued)

*Primary Examiner* — John K Fristoe, Jr.
*Assistant Examiner* — Jennifer C Chiang
(74) *Attorney, Agent, or Firm* — Judy Chung

(57) ABSTRACT

A package for a consumer care composition. The package comprises a container containing a consumer care composition, the container having a base for standing the package on a surface, a body portion above the base, a neck portion above the body portion, and a dispensing head above the neck portion. The body portion is aligned along a first axis and the neck portion is aligned along a second axis which is inclined to the first axis so that the dispensing head is directed upwardly and laterally towards a front of the container. The neck portion and the dispensing head have an exterior periphery which is not equal to that of the body portion.

14 Claims, 3 Drawing Sheets

(56) References Cited

U.S. PATENT DOCUMENTS

| | | | | | |
|---|---|---|---|---|---|
| D172,852 | S | | 8/1954 | Van Koert | |
| D176,590 | S | | 1/1956 | Breen | |
| 2,923,957 | A | * | 2/1960 | Gentile | 401/213 |
| 2,968,826 | A | * | 1/1961 | Leshin | 401/214 |
| 2,997,731 | A | * | 8/1961 | Schultz | 401/213 |
| D195,738 | S | | 7/1963 | Grasty | |
| D216,294 | S | | 12/1969 | Rias | |
| D216,460 | S | | 1/1970 | Gibson | |
| D234,940 | S | | 4/1975 | Mezquita | |
| D248,214 | S | * | 6/1978 | DiNuccio | D9/726 |
| D259,094 | S | | 5/1981 | Weckman | |
| D288,528 | S | | 3/1987 | Parad | |
| D307,714 | S | | 5/1990 | Rosenberg | |
| D323,110 | S | | 1/1992 | Simms et al. | |
| D325,520 | S | | 4/1992 | Biesecker | |
| 5,178,308 | A | | 1/1993 | Endre | |
| D343,117 | S | | 1/1994 | Mansau | |
| D360,583 | S | | 7/1995 | Paping | |
| D391,457 | S | | 3/1998 | Mason, III | |
| D392,890 | S | | 3/1998 | Zaksenberg | |
| D399,005 | S | | 9/1998 | Chan et al. | |
| 5,924,221 | A | * | 7/1999 | Schuver et al. | 36/136 |
| D423,360 | S | | 4/2000 | Hirato et al. | |
| D429,161 | S | | 8/2000 | LePage | |
| D432,918 | S | | 10/2000 | Aftoora | |
| 6,132,126 | A | * | 10/2000 | Sheffler et al. | 401/213 |
| 6,305,562 | B1 | | 10/2001 | Chan et al. | |
| 6,328,496 | B1 | * | 12/2001 | Hill et al. | 401/209 |
| 6,357,945 | B1 | * | 3/2002 | Losier et al. | 401/175 |
| D475,927 | S | | 6/2003 | Maddy | |
| D481,636 | S | | 11/2003 | Camacho | |
| D498,676 | S | | 11/2004 | Crawford | |
| 6,814,520 | B1 | * | 11/2004 | Delli Venneri et al. | 401/213 |
| D512,637 | S | | 12/2005 | De Monclin | |
| D519,376 | S | | 4/2006 | Ames | |
| D531,905 | S | | 11/2006 | Day | |
| D532,308 | S | | 11/2006 | Davies et al. | |
| D538,483 | S | | 3/2007 | Bakic | |
| D538,668 | S | | 3/2007 | Campbell et al. | |
| D543,851 | S | | 6/2007 | Franic | |
| D558,049 | S | | 12/2007 | Eaton et al. | |
| D560,017 | S | | 1/2008 | Morris et al. | |
| D588,459 | S | | 3/2009 | Davis et al. | |
| D588,460 | S | | 3/2009 | Davis et al. | |
| D592,527 | S | | 5/2009 | Serio et al. | |
| D592,957 | S | | 5/2009 | Davis et al. | |
| D601,899 | S | | 10/2009 | Davis et al. | |
| 8,261,972 | B2 | * | 9/2012 | Ziegler | 235/375 |
| 2002/0012565 | A1 | | 1/2002 | Sirna et al. | |
| 2009/0123219 | A1 | * | 5/2009 | Baltzell | 401/209 |
| 2009/0261100 | A1 | | 10/2009 | McMinn | |

FOREIGN PATENT DOCUMENTS

| | | | | |
|---|---|---|---|---|
| CD | 000573431-0009 | | | 10/2006 |
| DE | 3402614 | A1 | * | 8/1985 |
| EP | 1 472 953 | | | 11/2004 |
| EP | 1 621 181 | | | 2/2006 |
| GB | 2 272 186 | | | 5/1994 |
| RU | 48287 | | | 10/2005 |
| RU | 49385 | | | 11/2005 |
| RU | 49531 | | | 11/2005 |
| RU | 49917 | | | 12/2005 |
| RU | 57852 | | | 10/2006 |
| WO | WO 02/28546 | | | 4/2002 |

OTHER PUBLICATIONS

Written Opinion of the International Preliminary Examining Authority issued in International Application PCT/US2010/061612 mailed Jul. 23, 2013.

* cited by examiner

CONSUMER CARE PACKAGING

CROSS-REFERENCE TO RELATED APPLICATIONS

The present application is a U.S. national stage application under 35 U.S.C. §371 of International Application No. PCT/US2010/061612, filed Dec. 21, 2010, the entirety of which is incorporated herein by reference.

FIELD OF THE INVENTION

The present invention relates to a package for a consumer care composition, for example an antiperspirant composition, a deodorant composition, a soap composition, a detergent composition, a fabric softener composition, an oral care composition or other compositions for consumer use.

BACKGROUND OF THE INVENTION

It is well known to provide a variety of different roll-ball dispensers for consumer care compositions. A bottle contains the liquid consumer care composition and a roll-ball is held captive at a head at the top of the bottle, the roll-ball being covered by a removable cap when the product is not in use. It is possible to invert the bottle prior to use in order to apply the liquid composition to an inwardly directed surface of the ball prior to rotating the ball against the skin to deposit the liquid composition on a desired area of the skin. Such packages are generally intended to have an aesthetic appeal as well as provide an ergonomic design for ease of application of the consumer care composition to the body of the user or other surface.

It is known to provide a number of different package designs which purport to meet these design criteria of aesthetic appeal combined with an ergonomic design. For example, it is known to provide a linear or angled relationship between the body of the bottle and the head of the bottle to provide convenient application to particular parts of the body, for example the underarm area, and concave or convex surfaces of the bottle for ease of manual handling, in particular secure gripping. US-A-2002/012565 discloses such an angled head.

Nevertheless, there is a need in the art for a package for a consumer care composition which provides improved manual control by the user and easier application to only desired areas of the skin.

There is also a need in the art for a package for a consumer care composition which is easier to use, in particular to provide an initial wetting of the ball by the liquid composition.

There is furthermore a need in the art for a package for a consumer care composition which exhibits improved aesthetic appeal.

BRIEF SUMMARY OF THE INVENTION

According to one embodiment, the present invention provides a package for a consumer care composition, the package comprising a container containing a consumer care composition, the container having a base for standing the package on a surface, a body portion above the base, a neck portion above the body portion, and a dispensing head above the neck portion, the body portion being aligned along a first axis and the neck portion being aligned along a second axis which is inclined to the first axis so that the dispensing head is directed upwardly and laterally towards a front of the container, the neck portion and the dispensing head having an exterior periphery which is not equal to that of the body portion.

Optionally, in some embodiments the package is a roll-ball dispenser for a liquid consumer care composition and the dispensing head includes a roll-ball captive in the head.

Optionally, in some embodiments the consumer care composition is an antiperspirant composition and/or a deodorant composition.

Optionally, in some embodiments the first axis is orthogonal to the base.

Optionally, in some embodiments the dispensing head has an exterior periphery which is less than that of the neck portion.

Optionally, in some embodiments at each of front and rear surfaces of the container, the neck portion and the body portion are connected by a continuously curved intersection.

Optionally, in some embodiments at each of front and rear surfaces of the container, the neck portion and the body portion are connected by a bend in the container.

Optionally, in some embodiments the cross-sectional area of the container at the neck portion is less than that at the base.

Optionally, in some embodiments the cross-sectional area of the container at the head portion is less than that at the base.

Optionally, in some embodiments the cross-sectional area of the container progressively decreases from the base to the bottom of the head portion.

Optionally, in some embodiments the cross-sectional area of the container at the neck portion is greater than that at the base.

Optionally, in some embodiments the cross-sectional area of the container at the head portion is greater than that at the base.

Optionally, in some embodiments the cross-sectional area of the container progressively increases from the base to the bottom of the head portion.

Optionally, in some embodiments the cross-sectional area of the container is substantially constant from the base to the bottom of the head portion.

Optionally, in some embodiments the second axis is inclined to the first axis at an acute angle of from 5° to 40°. Further optionally, the second axis is inclined to the first axis at an acute angle of from 10° to 30°.

Optionally, in some embodiments the package further comprises a cap removably connected to an end of the neck portion and covering the roll-ball, wherein the cap has an exterior side surface which mates with the adjacent surface of the neck portion so that the exterior surfaces of the container and cap are smoothly continuous at a parting line therebetween.

Optionally, in some embodiments the package further comprises a removable self-adhesive label on an exterior surface of the cap, the cap and label being adapted so that pulling away of the label from the exterior surface of the cap causes release of an aroma or fragrance of the product packaged within the container.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

The following description of the preferred embodiment(s) is merely exemplary in nature and is in no way intended to limit the invention, its application, or uses.

It should be understood that the detailed description and specific examples, while indicating embodiments of the invention, are intended for purposes of illustration only and are not intended to limit the scope of the invention.

The following definitions and non-limiting guidelines must be considered in reviewing the description of this invention set forth herein. The headings (such as "Background Of The Invention" and "Summary Of The Invention,") used herein are intended only for general organization of topics within the disclosure of the invention, and are not intended to limit the disclosure of the invention or any aspect thereof. In particular, subject matter disclosed in the "Background Of The Invention" may include aspects of technology within the scope of the invention, and may not constitute a recitation of prior art. Subject matter disclosed in the "Summary Of The Invention" is not an exhaustive or complete disclosure of the entire scope of the invention or any embodiments thereof.

The citation of references herein does not constitute an admission that those references are prior art or have any relevance to the patentability of the invention disclosed herein. Any discussion of the content of references cited in the Background is intended merely to provide a general summary of assertions made by the authors of the references, and does not constitute an admission as to the accuracy of the content of such references. Each and every reference cited herein is hereby incorporated by reference in its entirety.

The detailed description, while indicating embodiments of the invention, is intended for purposes of illustration only and is not intended to limit the scope of the invention. Moreover, recitation of multiple embodiments having stated features is not intended to exclude other embodiments having additional features, or other embodiments incorporating different combinations the stated of features.

As used herein, the words "preferred" and "preferably" refer to embodiments of the invention that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the word "include," and its variants, is intended to be non-limiting, such that recitation of items in a list is not to the exclusion of other like items that may also be useful in the dispensers of this invention.

Figure 1:
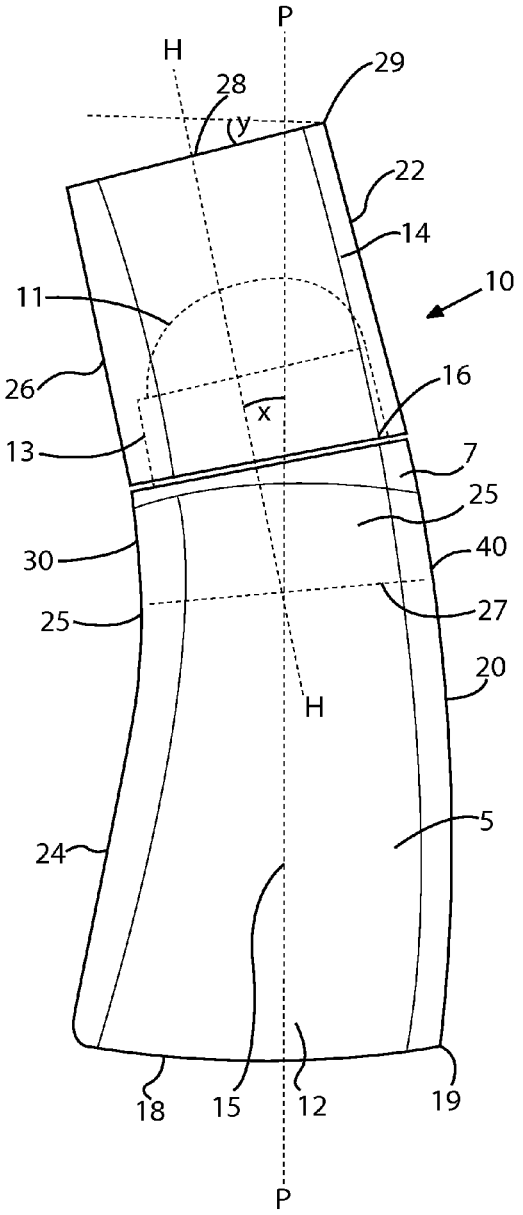
FIG. 1 schematically illustrates a side view of a package for a consumer care composition in accordance with a first embodiment of the present invention.
Figure 2:
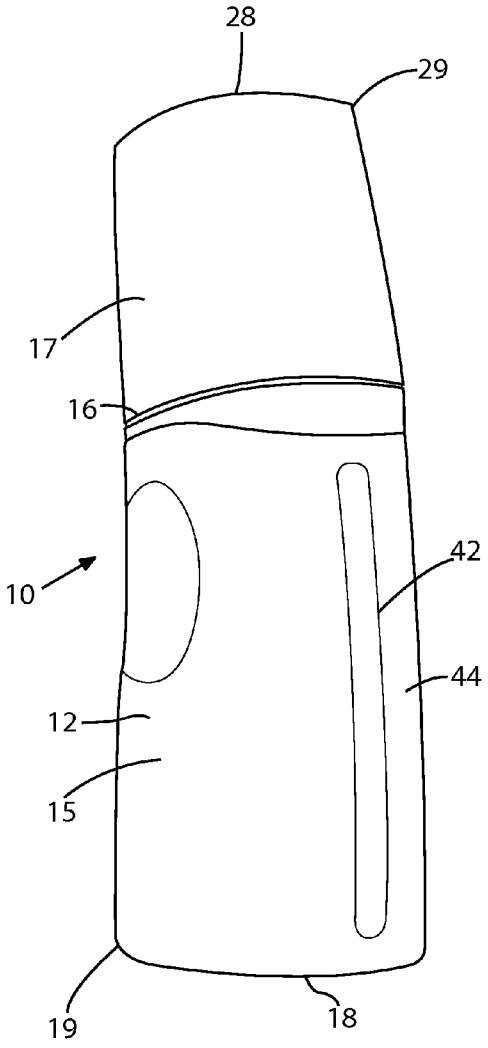
FIG. 2 schematically illustrates a perspective view, from the rear and one side, of the package of FIG. 1.

FIG. 1 schematically illustrates a side view of a package, designated generally as 10, for a consumer care composition in accordance with a first embodiment of the present invention. FIG. 2 schematically illustrates a perspective view, from the rear and one side, of the package 10 of FIG. 1.

Referring in detail to FIGS. 1 and 2, the package 10 is a roll-ball dispenser for a consumer care composition such as an antiperspirant composition and/or a deodorant composition. A container in the form of a bottle 12 contains the liquid consumer care composition and a roll-ball 11 (shown in phantom in FIG. 1) is held captive at a dispensing head 13 at the top of the bottle 12. The roll-ball 11 is covered by a removable cap 14 when the product is not in use. The cap 14 is typically removably connected to the bottle 12 by a threaded or snap-fit connection, there being a parting line 16 at the junction between the lower edge of the cap 14 and the upper edge of the bottle 12.

The bottle 12 has a substantially planar base 18 to enable the bottle 12 to stand upon a surface. The dispensing head 13 is located above a neck portion 7 which extends from a body portion 5 located above the base 18. A rear wall 20 extends upwardly from the base 18 and has a smoothly convex exterior surface with substantially continuous curvature. A front wall 24 extends upwardly from the base 18 and the exterior surface has a lower substantially planar portion 24 connected to an upper concave portion 25. The front wall 24 and rear wall 20 are asymmetrical, to provide an inclined dispensing head 13 which is oriented upwardly and towards the front wall 24. The bottle 12 is ergonomically shaped and dimensioned so that when the bottle 12 is grasped in the hand the thumb of the user can rest against the upper concave portion 25 of the front wall 24 and the fingers of the user can rest against the rear wall 20. The opposite side-walls 15 of the bottle 12 may be planar on non-planar and parallel or inclined. In the illustrated embodiment the side-walls 15 are upright, substantially planar and substantially parallel.

The cap 14 correspondingly has a rear wall 22 and a front wall 26 which mate respectively with the rear wall 20 and the front wall 24 of the bottle 12 when the cap 14 is closed, so that the combination of the bottle 12 and cap 13 have substantially continuous rear and front surfaces 40, 30. The cap 14 also has side-walls 17 which correspondingly mate with the side-walls 15 of the bottle 12. This provides a unitary design for the bottle 12 and cap 14, so that in the closed configuration the one is a continuation of the other, and the outer surfaces of the bottle 12 and cap 14 are smoothly continuous at the parting line 16.

The cap 14 also has a top wall 28, which is substantially planar. The top wall 28 is inclined to the substantially planar base 18 of the bottle 12. Accordingly, when the bottle 12 is stood on the base 18, the top wall 28 of the cap 14 is inclined at an angle to the base 18, and consequently to the surface on which the package 10 is standing.

Typically, the top wall 28 of the cap 14 is inclined at an acute angle y, typically from 5° to 40°, more typically from 15° to 35°, to the planar base 18 of the bottle 12. The angle selected may be varied dependent upon the dimensions of the bottle 12 and cap 14, and in particular on the dimensions of the base 18 and the top wall 28, to provide that in either standing orientation, upright or inverted, the centre of gravity of the package 10 lies within the exterior periphery of the respective standing surface so that the package 10 is stable independent of the fill level of any consumer care composition within the package 10. For each of the other embodiments, a similar angular relationship between the base and the top wall may be provided.

As is conventional, the substantially planar base 18 of the bottle 12 has a peripheral edge 19 which has both shape and dimensions so that irrespective of the fill level of the liquid product within the bottle 12, when the bottle 12 is upright and standing on the base 18 the centre of gravity of the bottle 12, with or without the cap 14, lies within the area defined by the peripheral edge 19. This ensures that the package can stand upright in a stable manner, without tipping over, throughout the lifetime of the product within the package 10.

As described above, the inclined dispensing head 13 is oriented laterally towards the front of the bottle 12. The dispensing head 13 is oriented along a head axis H-H which is inclined at an acute angle x, typically from 5° to 40°, more typically from 10° to 30°, to the primary axis P-P of the bottle 12, the latter being orthogonal to the base 18.

Such an angled orientation for the roll-ball head 13 provides a directional orientation for the roll-ball 11, so that the skin-contacting face of the roll-ball 11 points away from the primary axis P-P.

The upper neck portion 7 of the bottle 12 upon which the dispensing head 13 is disposed, and which is inclined along the axis H-H, has external dimensions which can be the same, greater than or less than those of the lower body portion 5 of the bottle 12 which is aligned along the axis P-P. The neck portion 7 and body portion 5 are connected at a curved intersection 27 in the bottle 12, so that the neck portion 7 extends in an angled orientation away from the body portion 5 to be held by the hand. In one embodiment, the ball diameter may be selected so that the roll-ball 11 and the head 13 therefor have external dimensions which are less than those of the neck portion 7 of the bottle 12. This provides a slender neck structure 25 for the package 10 in that the cross-sectional area of the package 10 does not increase at the neck portion 7 or dispensing head 13 as compared to the body portion 5 or base 18. In another embodiment, the ball diameter may be selected so that the roll-ball 11 and the head 13 therefor have external dimensions which are greater than those of the neck portion 7 of the bottle 12. This provides a slender body portion 5 for the package 10 in that the cross-sectional area of the package 10 increases at the neck portion 7 or dispensing head 13 as compared to the body portion 5 or base 18.

Such a directional orientation of the roll-ball 11 provides a roll-ball package 10 which can exhibit improved manual control for achieving targeted application of the liquid antiperspirant/deodorant product to desired surfaces of the skin, the inclined roll-ball on the extending neck providing clearance of the fingers and the body of the package 10 to avoid unintended contact with the skin in the vicinity of the underarm.

Such an angled bottle 12 also provides the advantage that the bottle 12 requires a reduced degree of tilt or inversion of the bottle 12 to provide an initial wetting of the interior surface of the roll-ball 11 facing the interior of the bottle 12 which contains the liquid antiperspirant/deodorant product.

The angled bottle shape also provides a distinctive aesthetic front view for visual impact of the package in a retail environment. The combination of the bottle 12 and cap 14 has substantially continuous rear and front surfaces 40, 30. The angle of the roll-ball head 14 is emphasised by the corresponding angle of the cap 14.

In accordance with this embodiment of the invention, a further aspect is provided in that the top wall 28 of the cap also has a peripheral edge 29 which has both shape and dimensions so that, irrespective of the fill level of the liquid product within the bottle 12, when the bottle 12 is inverted and standing on the cap 14 the centre of gravity of the bottle 12 lies within the area defined by the peripheral edge 29.

Accordingly, when the cap 14 is fitted to bottle 12, the package 10 may be selectively stood upright either on its bottle end or on its cap end.

This selective orientation of the package 10 provides a number of technical advantages.

First, the package 10 can be shipped to retail outlets and merchandised to the consumer in a "ball-up" orientation, with the package 10 stood upright on the base 18 of the bottle 10. This provides that leakage of liquid product from the bottle 12, such leakage potentially occurring around the seal between the dispensing head 13 and the roll-ball 11, is minimized. However, the user can readily store the package 10 in an inverted orientation on the top wall 28 of the cap 14. This provides that the roll-ball 11 is maintained wet with the liquid product and ready to apply to the skin of the user. The user can alternatively, as desired, store the package 10 in an upright orientation on base 18 of the bottle 10. Then, when the bottle 12 is nearly empty of the liquid product, the package 10 may be inverted, and subsequently stored in such an inverted orientation, in order to maximize use-up of the product until the entire product within the bottle 12 is fully exhausted.

Yet further, such an asymmetrical and invertible package structure creates an aesthetically pleasing and distinctive package. The package not only provides shelf impact and disruption which is perceived by the consumer, but also provides a distinctive package shape in the home. The top wall of the cap and the base of the bottle are mutually inclined, and coupled with the structural and visual asymmetry of the front and rear walls of the package, it is not immediately apparent to the consumer that the package can be stably stood, without inadvertent tipping over, either on the base or on the cap, as desired. The package can be presented to the consumer in an upright orientation, and then the consumer can subsequently discover that the package can be stably stored in an inverted orientation. This can surprise and delight the consumer, and also, as explained above, provide technical advantages not only during shipping and merchandising but also during use by the consumer.

As shown in FIG. 2, the rear wall 20 is provided with a window 42 surrounded by a peripheral portion 44 of the rear wall 20. The window 42 is elongate and oriented in an upright configuration. The window 42 is transparent or translucent, and is adapted, together with the selected product within the bottle 12, to ensure that the product fill level within the bottle 12 can be seen through the window 42 by the user. Such an elongate window spanning at least a major portion of, or even the entire, initial product fill level within the bottle 10, permits the liquid level within the bottle to be visible to the user for an extended portion of the product life.

Figure 3:
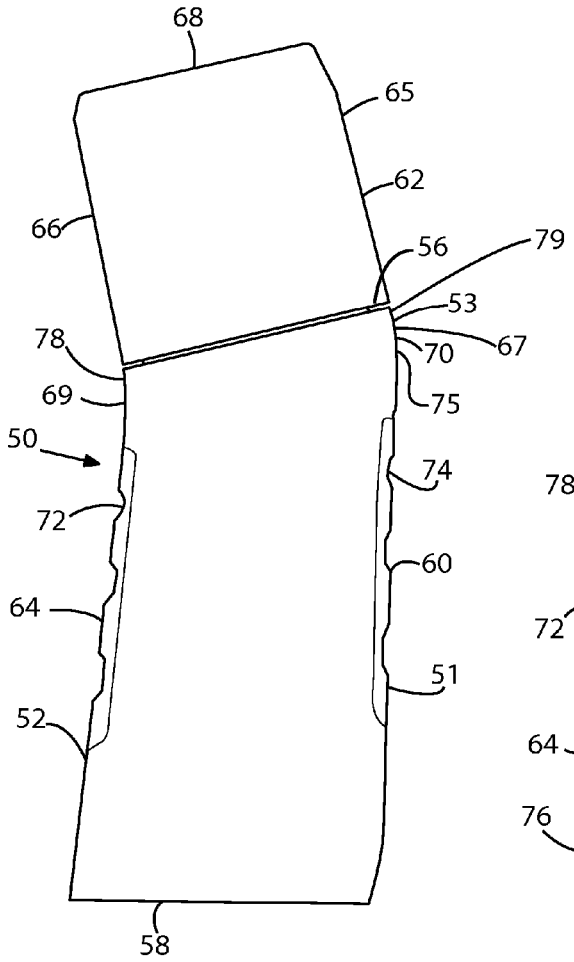
FIG. 3 schematically illustrates a side view of a package for a consumer care composition in accordance with a second embodiment of the present invention.
Figure 4:
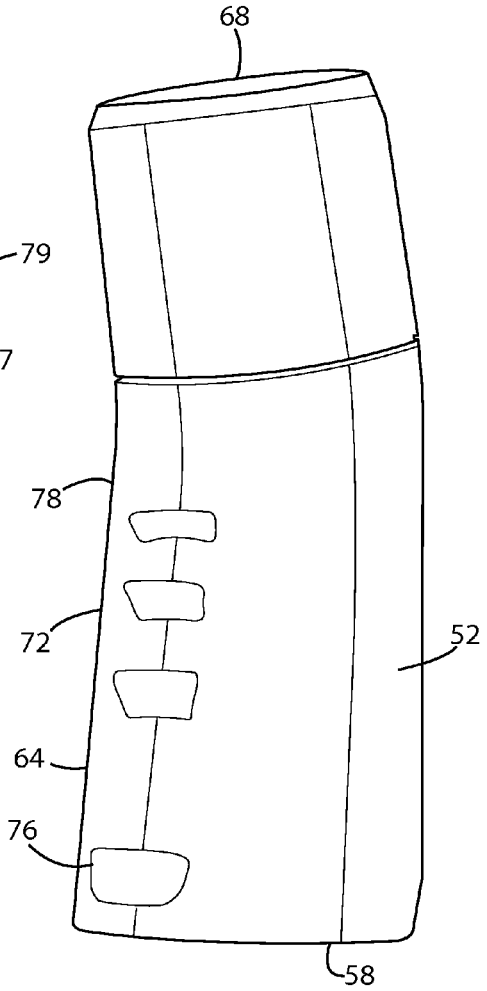
FIG. 4 schematically illustrates a perspective view, from the front and one side, of the package of FIG. 3.

FIGS. 3 and 4 illustrate a package, designated generally as 50, for a consumer care composition in accordance with a second embodiment of the present invention. This embodiment is similar to the first embodiment except that the front and rear walls of the bottle have a different shape and configuration and the window is located at a different location on the bottle. As for the first embodiment, a directional orientation of the roll-ball is provided on a slender neck structure.

Again, as for the first embodiment, the package 50 is a roll-ball dispenser for a consumer care composition such as an antiperspirant composition and/or a deodorant composition. A bottle 52 contains the liquid consumer care composition and a roll-ball (not shown) is held captive at a dispensing head (not shown) at the top of the bottle 52, the dispensing head being mounted on an angled neck portion 53. The roll-ball is covered by a removable cap 62 when the product is not in use. A parting line 56 is at the junction between the lower edge of the cap 62 and the upper edge of the bottle 52.

The bottle 52 has a substantially planar base 58. A rear wall 60 extends upwardly from the base 58 and is substantially planar except at a rear intersection 70 with the neck portion 53 at which the rear wall 60 inclines forwardly. A front wall 64 extends upwardly from the base 58 and is substantially planar except at a front intersection 69 at which the front wall 64 inclines forwardly to form the neck portion 53. The front intersection 69 and rear intersection 70 comprise the connection between the neck portion 53 and the lower body portion 51. The substantially planar portions of the front wall 64 and rear wall 60 are mutually inclined, in a converging manner in a direction upwardly away from the base 58, and are asymmetrical, to provide an inclined neck portion 53 which is oriented upwardly and towards the front wall 64.

The front wall 64 and rear wall 60 are respectively provided with a series of horizontally oriented inwardly moulded linear indents 72, 74 to assist gripping of the package 50 by the hands of the user, particularly when the package and/or hands are wet.

As described above, the inclined head and neck portion 53 are oriented towards the front wall 64. Again, the head and neck portion 53 are oriented along a head axis which is inclined at an acute angle to the primary axis of the bottle, the latter being orthogonal to the base 58.

Such an angled orientation for the roll-ball head and neck portion 53 provides a directional orientation for the roll-ball, so that the skin-contacting face of the roll-ball points away from the primary axis.

The neck portion 53 of the bottle 52 upon which the head is disposed, and which is inclined along the head axis, has external dimensions which are substantially the same as or less than those of the body portion 51 of the bottle 52 which is aligned along the primary axis. The upper neck portion 53 and lower body portion 51 are connected at a bend 67 in the bottle 52, so that the neck portion 53 extends in an angled orientation away from the body portion 51 to be held by the hand. Again, the ball diameter may be selected so that the roll-ball and the head therefor have external dimensions which are less than those of the neck portion 53 of the bottle 52. The inventions is not so limited however, and the head may have external dimension that is greater than those of the neck portion 53 of the bottle 52.

The cap 62 has a rear wall 65 and a front wall 66 which mate respectively with the upper ends 79, 78 of the rear wall 60 and the front wall 64 of the bottle 12 when the cap 62 is closed.

The cap 62 also has a top wall 68, which is substantially planar. The top wall 68 is inclined to the substantially planar base 58 of the bottle 52. Accordingly, as for the first embodiment, when the bottle 52 is stood on the base 58, the top wall 68 of the cap 62 is inclined at an angle to the base 58, and consequently to the surface on which the package 50 is standing.

Again, when the cap 62 is fitted to bottle 52, the package 50 may be selectively stood upright either on its bottle end or on its cap end.

As shown in FIG. 4, the front wall 64 is provided with a window 76 located slightly above the base 58. Again, the window 76 is transparent or translucent, and is adapted, together with the selected product within the bottle 52, to ensure that the product fill level within the bottle 52 can be seen through the window 76 by the user. Such a window 76 at the bottom of the bottle 52 near the base 58 provides that when the bottle is oriented "ball-up", the product fill level is visible to the user when the product within the bottle 52 is almost exhausted. The user would then know to invert the package in order to be able to use up the last remaining amount of the liquid product within the package.

In a modification of this embodiment, a window may be located at the ball-end of the bottle, either as an additional window to the window at the base or as an alternative window to the window at the base. Such a window location provides that when the when the bottle is oriented "ball-down" in an inverted orientation, the product fill level is visible to the user when the product within the bottle is almost exhausted. The user would then know that the package was nearly exhausted and required imminent replacement.

Figure 5:
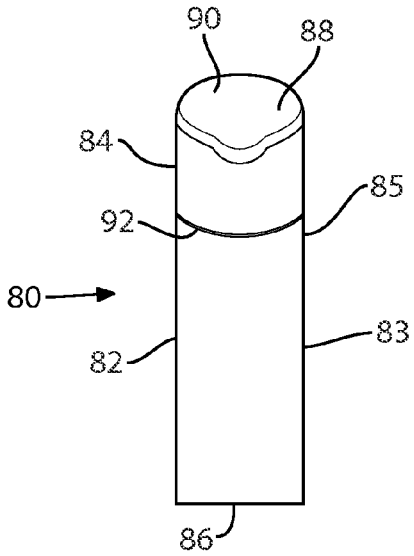
FIG. 5 schematically illustrates a front view of a package for a consumer care composition in accordance with a third embodiment of the present invention.
Figure 6:
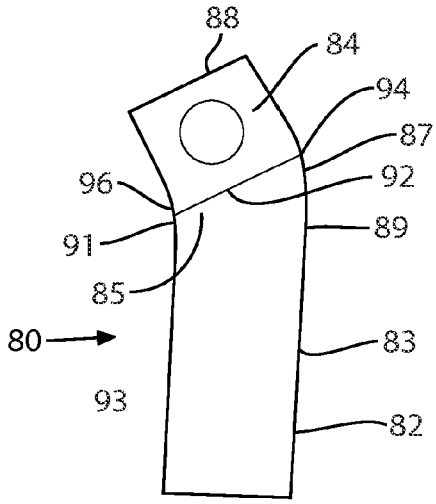
FIG. 6 schematically illustrates a side view of the package of FIG. 5.
Figure 7:
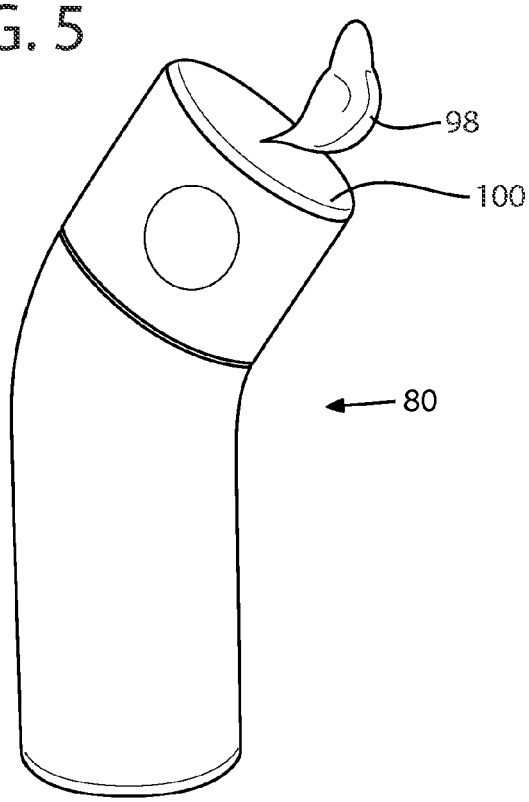
FIG. 7 schematically illustrates perspective view with a top label partly removed to release a fragrance.

FIGS. 5, 6 and 7 illustrate a package, designated generally as 80, for a consumer care composition in accordance with a third embodiment of the present invention. This embodiment is similar to the second embodiment except that the shape and configuration of the bottle and cap are different.

Again, as for the first and second embodiments, the package 80 is a roll-ball dispenser for a consumer care composition such as an antiperspirant composition and/or a deodorant composition. A bottle 82 contains the liquid consumer care composition and a roll-ball (not shown) is held captive at a head at the top of the bottle 82. The roll-ball is covered by a removable cap 84 when the product is not in use.

The bottle 82 has a substantially planar base 86. The bottle 82 has a substantially cylindrical body portion 83, and a substantially cylindrical neck portion 85, the neck portion 85 extending away from the body portion 83 at an inclined orientation. The substantially cylindrical body portion 83 and the substantially cylindrical neck portion 85 have the same exterior diameter.

The upper end 87 of the rear wall 89 is higher than the upper end 91 of the front wall 93 and so a parting line 92 between the bottle 82 and the cap 84 inclines forwardly.

The cap 84 mates with the bottle 82 and has a top wall 88, which is substantially planar and inclined to the substantially planar base 86 of the bottle 82. The top wall 88 of the cap 84 is covered by a removable self-adhesive label 90, which when pulled away from the top wall 88, as shown in FIG. 7, releases the aroma or fragrance of the product packaged within the bottle 82. The label 90 has a rearwardly-directed surface 98 coated with a pressure-sensitive adhesive which is releasably adhered to the outer surface 100 of the top wall 88. Either the label 90 temporarily seals one or more openings (not shown) extending through the top wall 88 or a sample of the aroma or fragrance of the product is disposed beneath the label 90.

Various other modifications to the disclosed embodiments will be apparent to those skilled in the art.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

What is claimed is:

1. A package for a consumer composition, the package comprising a container containing a consumer composition, the container having a base for standing the package on a surface, a body portion above the base, a neck portion above the body portion, and a dispensing head above the neck portion, the body portion being aligned along a first axis and the neck portion being aligned along a second axis which is inclined to the first axis so that the dispensing head is directed upwardly and laterally towards a front surface of the container, the neck portion and the dispensing head having an exterior periphery which is not equal to that of the body portion, wherein when the package is upright and standing on the base, the centre of gravity of the package lies within an area defined by a peripheral edge of the base;

wherein the container further comprises a rear surface opposite the front surface, the rear surface being continuously convex from the base to a top edge of the neck portion; and wherein the cross-sectional area of the container progressively decreases from the base to the top edge of the neck portion.

2. The package according to claim 1 wherein the package is a roll-ball dispenser for a liquid consumer care composition and the dispensing head includes a roll-ball captive in the dispensing head.

3. The package according to claim 1 wherein the consumer care composition is an antiperspirant composition and/or a deodorant composition.

4. The package according to claim 1 wherein the first axis is orthogonal to the base.

5. The package according to claim 1 wherein the dispensing head has an exterior periphery which is less than that of the neck portion.

6. The package according to claim 1 wherein at each of the front and rear surfaces of the container, the neck portion and the body portion are connected by a continuously curved intersection.

7. The package according to claim 1 wherein at each of the front and rear surfaces of the container, the neck portion and the body portion are connected by a bend in the container.

8. The package according to claim 1 wherein the cross-sectional area of the container at the neck portion is less than that at the base.

9. The package according to claim 1 wherein the cross-sectional area of the container at the dispensing head is less than that at the base.

10. The package according to claim 1 wherein the second axis is inclined to the first axis at an acute angle of from 5° to 40°.

11. The package according to claim 10 wherein the second axis is inclined to the first axis at an acute angle of from 10° to 30°.

12. The package according to claim 1 further comprising a cap removably connected to the top edge of the neck portion, wherein the cap has an exterior side surface which mates with the adjacent surface of the neck portion so that the exterior surfaces of the container and cap are smoothly continuous at a parting line therebetween.

13. The package according to claim 12 further comprising a removable self-adhesive label on an exterior surface of the cap, the cap and label being, adapted so that pulling away of the label from the exterior surface of the cap causes release of an aroma or fragrance of the product packaged within the container.

14. The package of claim 1 wherein the front surface comprises a lower portion that extends from the base to a transition point and an upper portion that extends from the transition point to the top edge of the neck, the upper portion being concave and the lower portion being substantially planar.

* * * * *